US009768539B2

(12) United States Patent
Zweigle et al.

(10) Patent No.: US 9,768,539 B2
(45) Date of Patent: Sep. 19, 2017

(54) ELECTRICAL PLUG CONNECTION HAVING A PLUG AND A SOCKET

(71) Applicant: Robert Bosch GmbH, Stuttgart (DE)

(72) Inventors: Peter Zweigle, Ditzingen (DE); Walter Fleischer, Bietigheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 277 days.

(21) Appl. No.: 14/101,977

(22) Filed: Dec. 10, 2013

(65) Prior Publication Data

US 2014/0170911 A1 Jun. 19, 2014

(30) Foreign Application Priority Data

Dec. 13, 2012 (DE) ..... 10 2012 223 017

(51) Int. Cl.
*H01R 13/11* (2006.01)
*H01R 103/00* (2006.01)

(52) U.S. Cl.
CPC ..... *H01R 13/112* (2013.01); *H01R 2103/00* (2013.01)

(58) Field of Classification Search
CPC ..... H01R 11/22; H01R 9/226; H01R 13/11; H01R 13/15; H01R 13/17; H01R 13/112; H01R 13/113; H01R 13/114; H01R 13/115
USPC ..... 439/817, 268, 844, 842, 845, 849, 850
See application file for complete search history.

(56) References Cited

U.S. PATENT DOCUMENTS

| | | | | |
|---|---|---|---|---|
| 4,943,248 | A * | 7/1990 | Colleran et al. | 439/850 |
| 4,944,700 | A * | 7/1990 | Simon | 439/801 |
| 5,542,850 | A * | 8/1996 | Frantz | H01R 12/716 439/12 |
| 6,692,316 | B2 * | 2/2004 | Hsieh et al. | 439/845 |
| 2006/0141825 | A1 * | 6/2006 | Nakagawa et al. | 439/78 |
| 2012/0052711 | A1 * | 3/2012 | Hasegawa | 439/345 |
| 2012/0156947 | A1 * | 6/2012 | Tyler | H01R 13/113 439/842 |

FOREIGN PATENT DOCUMENTS

| | | | |
|---|---|---|---|
| CN | 201369430 | Y | 12/2009 |
| DE | 103 51 504 | | 6/2005 |
| JP | 2003045537 | A | 2/2003 |
| JP | 2008300167 | A | 12/2008 |

* cited by examiner

*Primary Examiner* — James Harvey
*Assistant Examiner* — Oscar C Jimenez
(74) *Attorney, Agent, or Firm* — Norton Rose Fulbright US LLP; Gerard Messina

(57) ABSTRACT

An electrical plug connection having a plug and a socket, the socket having two contact zones located opposite to one another, which are each implemented on one spring arm, the spring arms allowing an insertion gap present between the contact zones to be elastically widened transversely to a plug axis during the insertion of the plug. The plug axis of the plug has an angle not equal to zero in relation to a longitudinal axis of the spring arms.

13 Claims, 4 Drawing Sheets

ELECTRICAL PLUG CONNECTION HAVING A PLUG AND A SOCKET

RELATED APPLICATION INFORMATION

The present application claims priority to and the benefit of German patent application no. 10 2012 223 017.3, which was filed in Germany on Dec. 13, 2012, the disclosure of which is incorporated herein by reference.

FIELD OF THE INVENTION

The present invention relates to an electrical plug connection according to the definition of the species in Claim 1, and a socket and an electrical actuator according to the concurrent independent patent claims.

BACKGROUND INFORMATION

Electrical plug connections which are embodied according to the principle of a plug and a socket are known from the market, the socket having two or more contact elements, between which the plug—embodied as a flat pin, for example—may be inserted to establish an electrical connection. Such electrical plug connections are manufactured for a variety of possible applications and are installed in corresponding terminals.

Such an electrical plug connection is known, for example, from an electromagnetic pressure valve from patent publication DE 103 51 504 A1.

SUMMARY OF THE INVENTION

The object on which the present invention is based is achieved by an electrical plug connection as described herein, and by a socket and an electrical actuator as described herein.

Advantageous refinements are specified in the further descriptions herein. Furthermore, features which are important for the present invention are found in the following description and in the drawings, the features being important for the present invention both alone and also in different combinations, without this being explicitly noted once again.

The present invention has the advantage that an electrical plug connection, which is embodied having so-called fork contacts, may have particularly small dimensions. A variety of specific embodiments of the electrical plug connection is possible, whereby a corresponding design variety results.

The present invention relates to an electrical plug connection having a plug and a socket, the socket having two contact zones lying opposite to one another, which are each implemented on one spring arm, and the spring arms allowing an insertion gap present between the contact zones to be elastically widened transversely to a plug axis upon insertion of the plug. According to the present invention, the plug axis of the plug has an angle not equal to zero in relation to a longitudinal axis of the spring arms. The plug and the socket are thus not moved toward one another in the direction of the particular longitudinal axis during the plugging procedure and then electrically connected, but rather more or less at an "inclined" angle. The structural space of the electrical plug connection thus established is accordingly small. In particular, the socket may be placed very close to the associated component and only protrudes slightly.

In one embodiment of the present invention, the angle between the plug axis of the plug and the longitudinal axis of the spring arms is 90°. The structural space required for the electrical plug connection is thus particularly small.

In particular, it may be provided according to the present invention that the contact zones of at least the socket have a greatest extension in the direction of the plug axis. The maximum force to be applied during the plugging procedure is thus comparably small, so that bending of the spring arms in the plugging direction may be prevented. For this purpose, the spring arms are structurally implemented in a special manner, as explained in greater detail hereafter. One advantage thus results with respect to a so-called fork contact which is merely embodied as flat.

In one embodiment of the electrical plug connection, the contact zones are implemented on an angled section of the particular spring arm. A length of the angled section may be greater than a (material) thickness of the spring arm. Due to the angling, the contact zones of the socket have their greatest extension in the direction of the plug axis, whereby a comparably small force results during the insertion of the plug, with reliable contacting at the same time.

In a first variant, the angled section is angled toward a first direction of the plug axis, which faces toward the plug. The spring arms may thus be situated particularly close to the component. The spring arms are also subjected to torsion—at least during the insertion.

In a second variant, the angled section is angled toward a second direction of the plug axis, which faces away from the plug. This makes it easier for the component to be used as a bending stop, for example. The insertion of the plug may thus be performed in a particularly defined way, the risk being reduced that the angled section will be bent or even damaged. In addition, the torsion of the spring arms is generally less than in the case of the first variant.

In another embodiment of the electrical plug connection, the spring arms are each embodied in a U-shape, the contact zones each being embodied on a base of the U-shape, and at least one of the end sections of a leg of the U-shape of one spring arm being connected to the corresponding adjacent end section of the U-shape of the other spring arm, in particular embodied in one piece. In the present case, the section of the U-shape which connects the two legs is designated as a "base," it being possible to embody this as a whole as a 180° arc or, for example, with the aid of two 90° bends with a linear section located in between. The spring arms may be embodied together in one piece as a sheet-metal part, the bending of the U-shape being performed about an axis which lies in parallel to the sheet-metal plane. The widening of the insertion gap during the insertion of the plug occurs transversely to the thickness of the sheet metal in the area of the spring arms. A width of the spring arms, which is defined orthogonally to the thickness, may be always dimensioned as a function of a particular length coordinate of the spring arms. In other words: the embodiment of the spring arms takes into consideration the force acting on the contact zones as a transverse force and also takes into consideration the torque curve along the spring arms. Overall, the electrical plug connection embodied in this way is particularly robust and may be configured for high mechanical durability. In addition, this embodiment has the advantage that the contact zones have an essentially constant surface pressure when the plug is inserted, since torsion of the spring arms is nearly avoided.

The electrical plug connection may be manufactured particularly simply and cost-effectively for all of the above-described embodiments if the plug and/or the socket is/are embodied as a stamped and/or bent sheet-metal part. In addition, it may be provided that the contact zones of the plug and/or the socket are reworked, in that edges of the sheet-metal part are rounded by grinding, for example. In addition, the contact zones may be electroplated with gold or nickel in a way known per se.

In another embodiment of the present invention, it is provided that the electrical plug connection has at least two plugs (and associated sockets), the protruding end of one plug being situated offset longitudinally to the plug axis in relation to the protruding end of the other plug. Thus, during the plugging procedure, first one of the plugs is (partially) inserted into the associated socket, and then the second plug is inserted into the associated socket. The plugging force during the plugging procedure may thus be considerably reduced, in particular during the first contact of the contact partners.

Alternatively thereto, the plugging force during the plugging procedure may be reduced if the electrical plug connection has at least two sockets (and associated plugs), the contact zones of one socket being situated offset longitudinally to the plugging axis with respect to the contact zones of the other socket. The contact zones are thus situated offset in the plugging direction on the angled section of the spring arm or in the plugging direction along the rounded area of the U-shape. Thus, first one of the plugs makes contact on the associated socket during the plugging procedure, and then the second plug. According to the present invention, the offset arrangement of the contact zones may thus be embodied on the plugs and/or on the sockets.

Furthermore, the socket according to the present invention of the electrical plug connection is claimed, which is embodied as described above in various embodiments. The associated plugs may also be a commercially available flat contact or the like. The electrical plug connection according to the present invention is thus usable in a particularly versatile way.

It is obvious that the electrical plug connection described above solely by way of its electrically conductive elements may be supplemented by way of suitable insulating materials to form a complete "plug" or a complete "socket." This supplementation is advantageous in particular to make handling of the electrical plug connection easier and/or to meet safety requirements with respect to short-circuit or contact. Furthermore, multiple electrical plug connections according to the present invention may thus additionally be situated in a shared housing, to allow a multipole contact.

It is also obvious that the electrical plug connection according to the present invention may also include a socket having contact zones which have the shape of cylinders which are halved lengthwise, the spring arms being applied to the cylinder halves in the direction toward one another. In this embodiment, the plug may be embodied as a cylindrical pin.

Furthermore, the present invention includes an electrical actuator, in particular for an automatic vehicle transmission, which has an electrical plug connection as recited in one of the preceding claims. A structural space or an installation space for the actuator may thus be reduced in size, whereby costs may also be saved.

Exemplary specific embodiments of the present invention are described hereafter with reference to the drawings.

DETAILED DESCRIPTION

Figure 1:
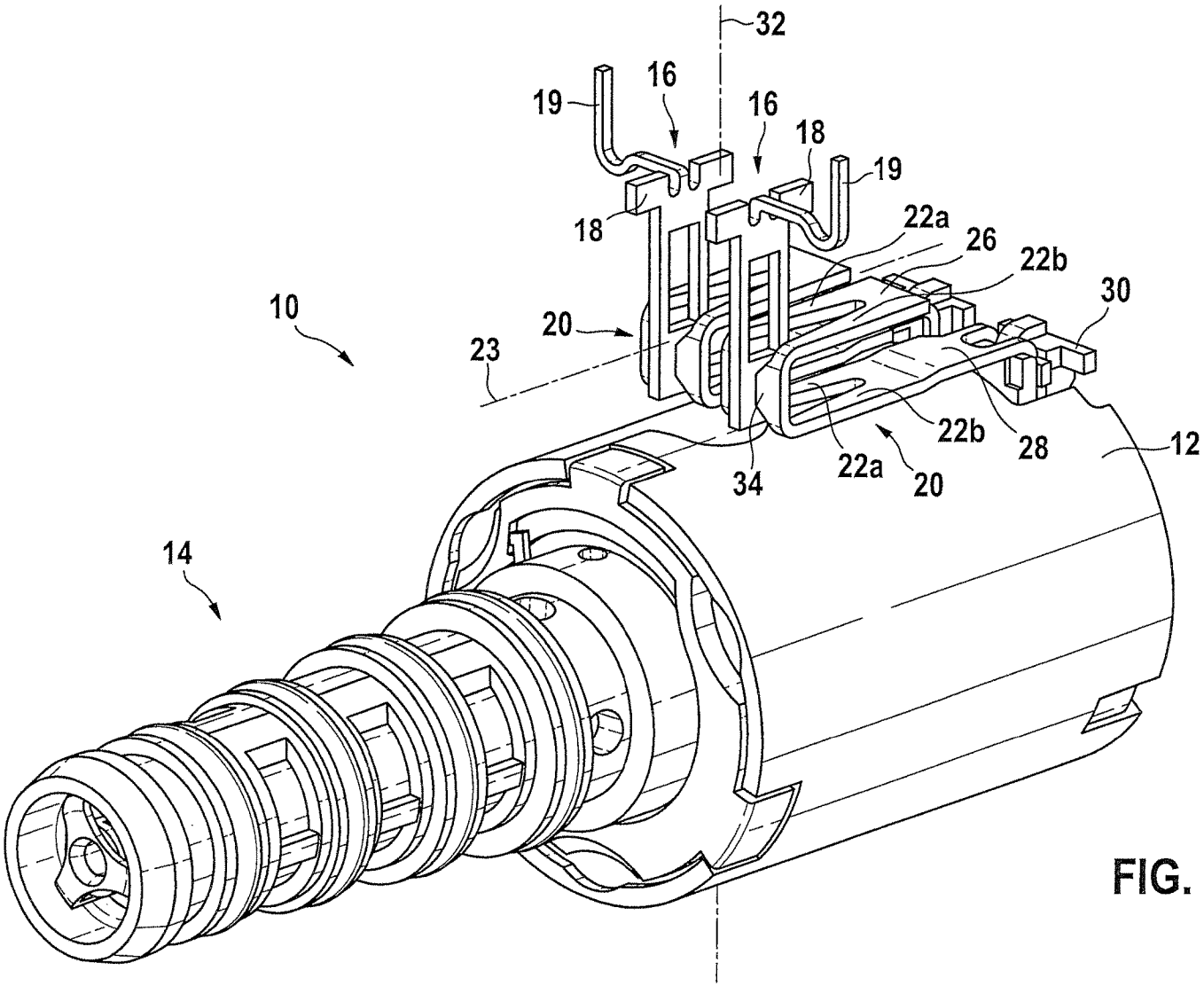
FIG. 1 shows a perspective view of an actuator for an automatic vehicle transmission having two electrical plug connections in a first specific embodiment.

The same reference numerals are used for functionally equivalent elements and variables in all figures, as well as in the case of different specific embodiments. Not all reference numerals are shown repeatedly on all elements and/or in all figures for the sake of clarity.

FIG. 1 shows an actuator 10, which is embodied as essentially cylindrical, for an automatic vehicle transmission (not shown). Actuator 10 includes a housing 12, in which an electromagnetic actuating unit (not visible) and a hydraulic slide valve (only partially visible) are situated. Furthermore, actuator 10 includes a plurality of hydraulic connections 14 in a left area in the drawing.

In an upper area in the drawing, two electrical plug connections 16 are situated, with the aid of which the electromagnetic actuator is connected at two poles. Electrical plug connections 16 each include an identical plug 18 and an identical socket 20. Plugs 18 are essentially embodied as flat contacts and have terminals 19, which are indicated in the drawing by a short bow above plugs 18. Terminals 19 are connected to plugs 18 by a spot weld, for example.

Socket 20 shown in FIG. 1 includes two spring arms 22*a* and 22*b*, which are each embodied in a U-shape. Spring arms 22*a* and 22*b* each have a longitudinal axis in parallel to a line 23. Contact zones 24*a* and 24*b* (see FIG. 2*a*), which are opposite to one another, of spring arms 22*a* and 22*b* are each embodied on a base 34 ("rounded area") of the U-shape, i.e., in a left area of socket 20 in the drawing. The protruding end sections of the two legs of the U-shape of spring arm 22*a* are mechanically and electrically connected to the protruding end sections of the two legs of the U-shape of adjacent spring arm 22*b*. For this purpose, an electrically conductive bridge 26 is provided on the end sections of the upper legs in the drawing, and a terminal element 28 is embodied as extended to the right in the drawing on the end sections of the lower legs in the drawing. Corresponding to contact zones 24*a* and 24*b* of socket 20, plug 18 has associated contact zones 24*c* and 24*d* (see FIG. 2*a*) on a respective side, which, when electrical plug connection 16 is plugged in, result in a match with contact zones 24*a* and 24*b* and therefore each only include a part of a lower section of plug 18 in the drawing.

Terminal element 28 is situated on an electrically insulating mount 30 or fastened thereon. Mount 30 is situated on housing 12 and therefore also holds entire socket 20 in a defined position. In contrast, bridge 26 is situated freely, i.e., it is not mechanically fixed by a mount or the like. Overall, socket 20 is embodied in one piece, in the present case, spring arms 22*a*, 22*b*, contact zones 24*a* and 24*b*, bridge 26, and terminal 28 being manufactured together as a stamped and bent sheet-metal part.

In one specific embodiment (not shown), electrical plug connection 16 has a housing manufactured from an insulating material, which may in each case include one single of sockets 20 or one single plug 18 or both sockets 20 or both plugs 18 together.

Figure 2A:
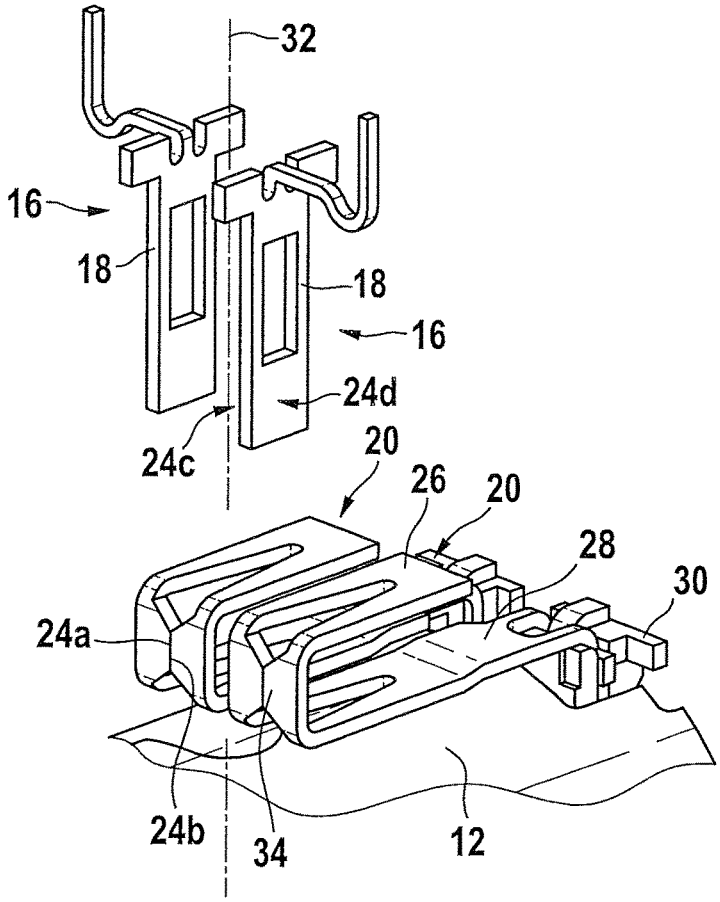
FIG. 2*a* shows a perspective view of the electrical plug connections of FIG. 1 in an unplugged state.
Figure 2B:
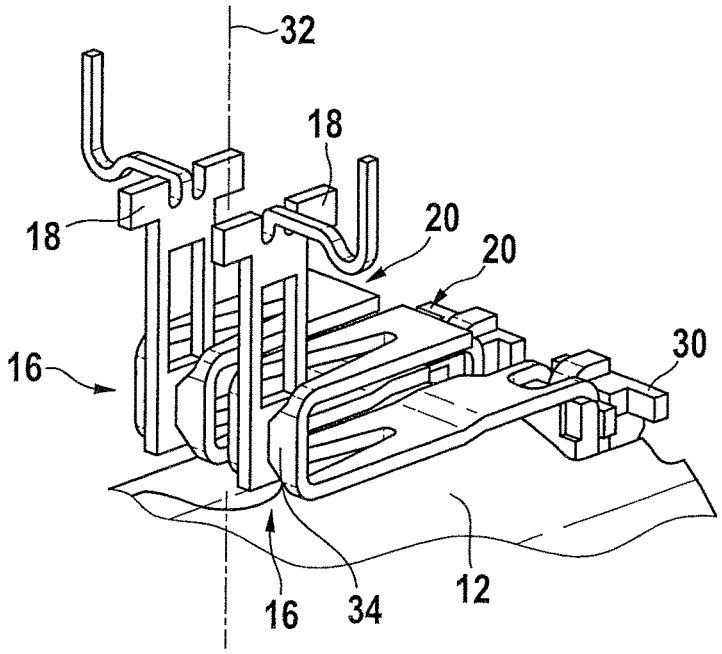
FIG. 2*b* shows a perspective view of the electrical plug connections of FIG. 1 in a plugged state.

An insertion of plug 18 into socket 20 in the direction of a plug axis 32, which is shown by a vertical line, to establish an electrically conductive connection is described in FIGS. 2*a* and 2*b*. Plug axis 32 and the longitudinal axis (line 23 in FIG. 1) of spring arms 22*a* and 22*b* have an angle not equal to zero to one another, 90° in the present case. This angle may also be dimensioned as deviating from 90° if necessary, whereby a so-called "inclined" electrical plug connection 16 results. Contact zones 24*a* and 24*b* of socket 20 may be also embodied at an identical "inclined" angle to the longitudinal axis of spring arms 22*a* and 22*b*. However, this is not shown in the drawing.

FIG. 2*a* shows electrical plug connections 16 of FIG. 1 in an unplugged state. Actuator 10 is only represented hereafter by a section of housing 12. As in FIG. 1, plug axis 32 is also shown as a vertical line in FIGS. 2*a* and 2*b*, in the direction of which plug 18 may be inserted in each case between spring arms 22*a* and 22*b* of associated socket 20.

In the state of FIG. 2*a*, spring arms 22*a* and 22*b* are arranged maximally adjacent as a result of their shape, contact zones 24*a* and 24*b* also approaching one another with a minimal or even disappearing insertion gap. Contact zones 24*a* and 24*b* of socket 20 only include a part of base 34 of the U-shape. It may be seen that base 34 of the U-shape has a wedge-shaped recess in each case in both directions of plug axis 32, whereby the insertion of plug 18 into socket 20 or the withdrawal of plug 18 out of socket 20 is made easier.

During the insertion of plug 18 into socket 20, the mentioned insertion gap is widened elastically transversely to plug axis 32. Particular contact zones 24*a*, 24*b*, 24*c*, and 24*d* corresponding to one another of plug 18 and socket 20 are pressed onto one another by spring arms 22*a* and 22*b* using a specific force, whereby a corresponding contact is established. Spring arms 22*a* and 22*b* are essentially subjected to bending (about an axis perpendicular to the sheet-metal plane of spring arms 22*a* and 22*b*), but not to torsion about the longitudinal axis (line 23). FIG. 2*b* shows the plugged state of electrical plug connection 16.

Figure 3:
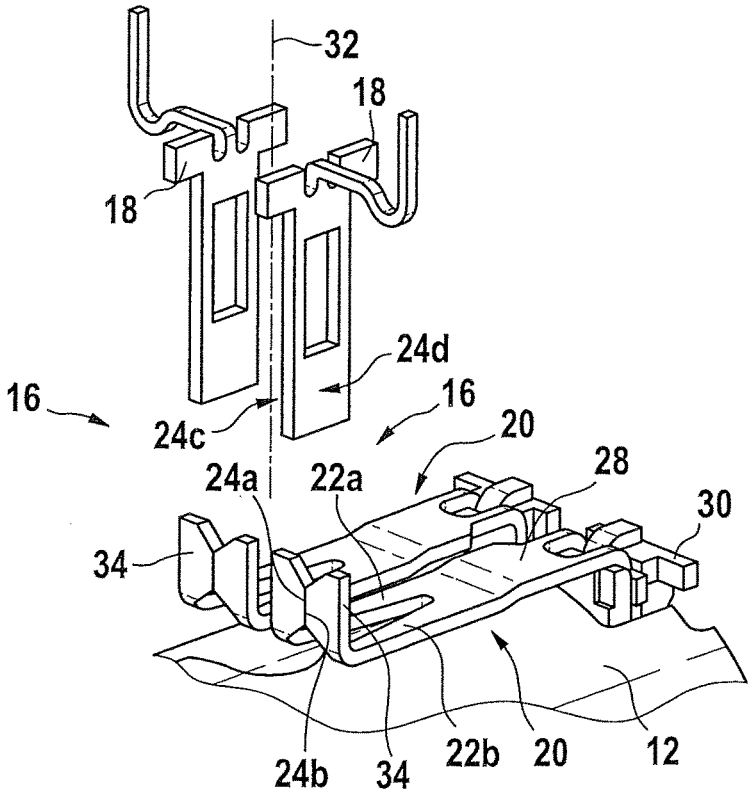
FIG. 3 shows a perspective view of the electrical plug connections in a second specific embodiment.

FIG. 3 shows electrical plug connection 16, in one alternative specific embodiment to FIGS. 1, 2*a*, and 2*b*, in an unplugged state. Contact zones 24*a* and 24*b* of socket 20 are implemented on an angled section 34 of particular spring arm 22*a* or 22*b*. In the present case, angled section 34 is angled toward a first direction (upward in the drawing) of plug axis 32, which faces toward plug 18 and away from housing 12 of actuator 10.

Figure 4:
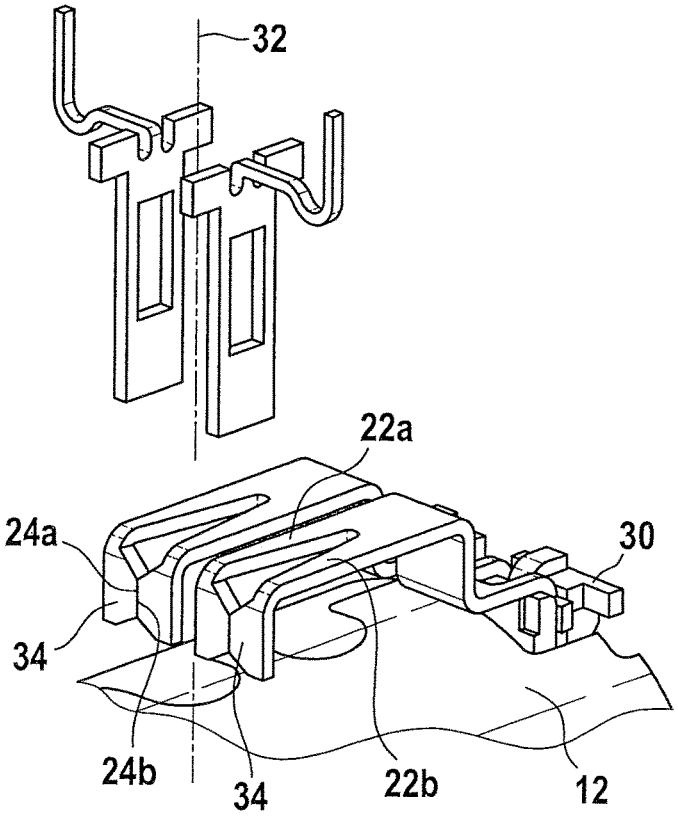
FIG. 4 shows a perspective view of the electrical plug connections in a third specific embodiment.

FIG. 4 shows electrical plug connection 16 in another specific embodiment in an unplugged state. Similarly to FIG. 3, spring arms 22*a* and 22*b* have an angled section 34. In the present case, angled section 34 is angled toward a second direction (downward in the drawing) of plug axis 32, which faces away from plug 18 and toward housing 12 of actuator 10.

Figure 5:
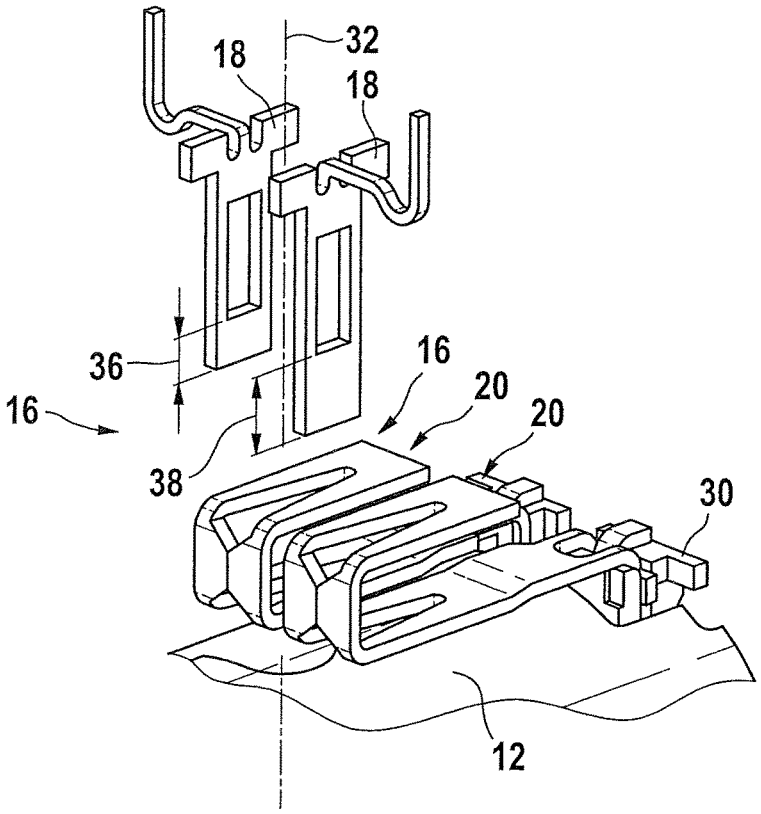
FIG. 5 shows a perspective view of the electrical plug connections in a fourth specific embodiment.

FIG. 5 shows the two electrical plug connections 16 in another specific embodiment. In the present case, both sockets 20 are embodied comparably to the specific embodiment of FIGS. 1, 2*a*, and 2*b*. However, plugs 18 of FIG. 5 have axial lengths 36 and 38, which differ from one another, of a particular end section facing toward sockets 20. The protruding end of one plug 18 is thus situated offset longitudinally to plug axis 32 in relation to the protruding end of other plug 18. A reduced force thus results during the insertion of plug 18 into socket 20, in that first front plug 18 in the drawing establishes a contact to associated socket 20, and then rear plug 18.

Figure 6:
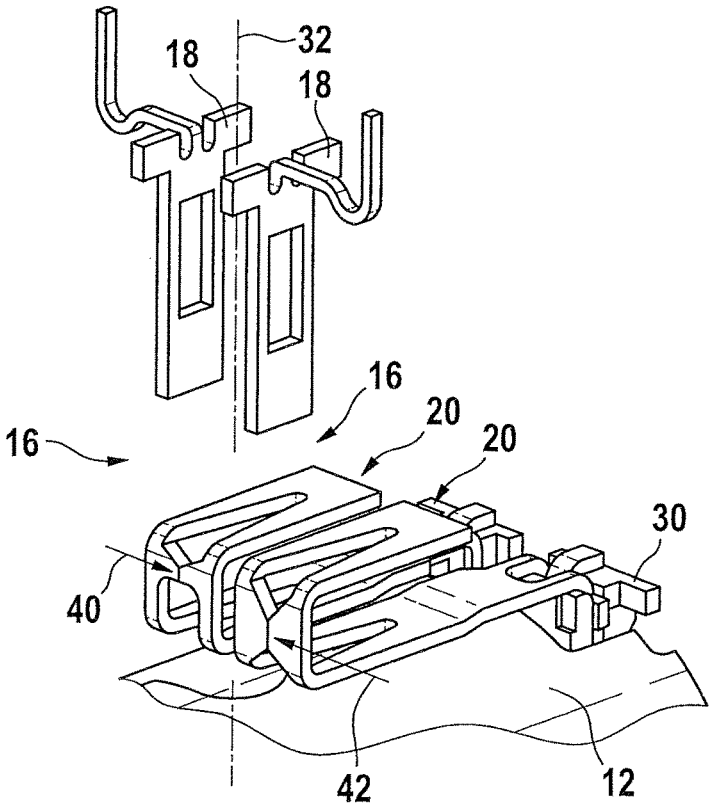
FIG. 6 shows a perspective view of the electrical plug connections in a fifth specific embodiment.

FIG. 6 shows the two electrical plug connections 16 in still another specific embodiment. In the present case, the two plugs 18 are embodied comparably to the specific embodiments of FIGS. 1 through 4. However, contact zones 24*a*, 24*b* of one socket 20 are situated offset longitudinally to plug axis 32 in relation to contact zones 24*a*, 24*b* of other socket 20, see arrows 40 and 42. Thus, similarly to the specific embodiment according to FIG. 5, a reduced force results during the insertion of plugs 18 into sockets 20, in that first the rear socket 20 in the drawing establishes a contact to associated plug 18, and then front socket 20.

The offsets, which are described in FIGS. 5 and 6, of plugs 18 or of contact zones 24*a* and 24*b* of sockets 20 may also be applied accordingly to the specific embodiments according to FIGS. 3 and 4. In one specific embodiment (not shown) of electrical plug connection 16, socket 20 is embodied employing cylinders halved lengthwise, spring arms 22*a* and 22*b* being applied to the cylinder halves in the direction toward one another. Plug 18 is embodied as a cylindrical pin matching thereto in this specific embodiment.

What is claimed is:

1. An electrical plug connection, comprising:

a plug; and a socket having two contact zones located opposite to one another, which are each implemented on a respective spring arm, the spring arms being elastically widened transversely to a plug axis during the insertion of the plug, wherein an insertion direction of the plug has an angle not equal to zero in relation to a longitudinal axis of the spring arms, wherein:

each spring arm forms a U-shape, the longitudinal axis of each spring arm is perpendicular to the insertion direction of the plug, and a base of the U-shape of each spring arm includes a surface that is perpendicular to the longitudinal axis of each spring arm and occupies a plane that is parallel to the insertion direction of the plug wherein the base of the U-shape is divided into first and second portions that contact each other in the absence of insertion of the plug, and in an inserted state of the plug in which the plug is inserted in the socket, the plug separates and is interposed between the first and second portions of the U-shape of the base so that the first and second portions no longer contact one another.

2. The electrical plug connection of claim 1, wherein the contact zones are implemented on an angled section of the particular spring arms.

3. The electrical plug connection of claim 2, wherein the angled section is angled toward a first direction of the plug axis, which faces toward the plug.

4. The electrical plug connection of claim 2, wherein the angled section is angled toward a second direction of the plug axis, which faces away from the plug.

5. The electrical plug connection of claim 1, wherein the contact zones each being embodied on the base of the U-shape and at least one of the end sections of one leg of the U-shape of one spring arm being connected, embodied in one piece, with the corresponding adjacent end section of one of the legs of the U-shape of the other spring arm.

6. The electrical plug connection of claim 1, wherein at least one of the plug and the socket is embodied as one of a stamped-metal part and a bent sheet-metal part.

7. The electrical plug connection of claim 1, wherein there are at least two plugs, a protruding end of the one plug being situated offset longitudinally to the plug axis in relation to the protruding end of the other plug.

8. The electrical plug connection of claim 1, wherein there are at least two sockets, the contact zones of the one socket being situated offset longitudinally to the plug axis in relation to the contact zones of the other socket.

9. The electrical plug connection of claim 1, wherein:

each base is located at a first end of each spring arm, and at a free end of a leg of the U-shape of each spring arm that is located opposite to the first end, each spring arm includes a conductive bridge.

10. A socket for an electrical plug connection, comprising:

a socket having two contact zones located opposite to one another, which are each implemented on a respective spring arm, the spring arms being elastically widened transversely to a plug axis during the insertion of a plug, wherein an insertion direction of the plug has an angle not equal to zero in relation to a longitudinal axis of the spring arms, wherein:

each spring arm forms a U-shape, the longitudinal axis of each spring arm is perpendicular to the insertion direction of the plug, and a base of the U-shape of each spring arm includes a surface that is perpendicular to the longitudinal axis of each spring arm and occupies a plane that is parallel to the insertion direction of the plug wherein the base of the U-shape is divided into first and second portions that contact each other in the absence of insertion of the plug, and in an inserted state of the plug in which the plug is inserted in the socket, the plug separates and is interposed between the first and second portions of the U-shape of the base so that the first and second portions no longer contact one another.

11. The socket of claim 10, wherein:

each base is located at a first end of each spring arm, and at a free end of a leg of the U-shape of each spring arm that is located opposite to the first end, each spring arm includes a conductive bridge.

12. An electrical actuator for an automatic vehicle transmission, comprising:

an electrical plug connection, including:

a plug; and a socket having two contact zones located opposite to one another, which are each implemented on a respective spring arm, the spring arms being elastically widened transversely to a plug axis during the insertion of the plug, wherein an insertion direction of the plug has an angle not equal to zero in relation to a longitudinal axis of the spring arms, wherein:

each spring arm forms a U-shape, the longitudinal axis of each spring arm is perpendicular to the insertion direction of the plug, and a base of the U-shape of each spring arm includes a surface that is perpendicular to the longitudinal axis of each spring arm and occupies a plane that is parallel to the insertion direction of the plug wherein the base of the U-shape is divided into first and second portions that contact each other in the absence of insertion of the plug, and in an inserted state of the plug in which the plug is inserted in the socket, the plug separates and is interposed between the first and second portions of the U-shape of the base so that the first and second portions no longer contact one another.

13. The electrical actuator of claim 12, wherein:

each base is located at a first end of each spring arm, and at a free end of a leg of the U-shape of each spring arm that is located opposite to the first end, each spring arm includes a conductive bridge.

* * * * *